United States Patent [19]

Pearl

[11] Patent Number: 5,055,065

[45] Date of Patent: Oct. 8, 1991

[54] SNAP

[76] Inventor: Marcella Pearl, Daniel Stalpert Straat 58 Huis, 1072 XJ Amsterdam, Netherlands

[21] Appl. No.: 442,842

[22] Filed: Nov. 29, 1989

[51] Int. Cl.[5] ..... H01R 4/24

[52] U.S. Cl. ..... 439/425; 439/592; 439/417

[58] Field of Search ..... 439/391–397, 439/404–407, 425, 426, 417, 418, 419, 592

[56] References Cited

U.S. PATENT DOCUMENTS

| | | | |
|---|---|---|---|
| 3,115,541 | 12/1963 | Hammer et al. | 439/425 |
| 4,525,019 | 6/1985 | Brasky | 439/404 |

FOREIGN PATENT DOCUMENTS

| | | | |
|---|---|---|---|
| 0077610 | 4/1983 | European Pat. Off. | 439/418 |
| 0095271 | 11/1983 | European Pat. Off. | 439/418 |
| 2061637 | 5/1981 | United Kingdom | 439/418 |

*Primary Examiner*—David L. Pirlot
*Attorney, Agent, or Firm*—Richard L. Miller

[57] ABSTRACT

An electric cord connector is provided and consists of a base member and a cap member that can be readily snap locked together so that electric cords extending therefrom will be in an operative electrically connected condition when pointed tip pins carried in the cap member pierce the electric cords.

2 Claims, 1 Drawing Sheet

SNAP

BACKGROUND OF THE INVENTION

The instant invention relates generally to wire connectors and more specifically it relates to an electric cord connector.

Numerous wire connectors have been provided in the prior art that are adapted to bridge together insulated wires so as to replace the customary twisted wire splices. For example U.S. Pat. No. 2,587,239 to Smith; U.S. Pat. No. 4,547,033 to White et al and U.S. Pat. No. 4,612,423 to Munroe all are illustrative of such prior art. While these units may be suitable for the particular purpose to which they address, they would not be as suitable for the purpose of the present invention as hereafter described.

SUMMARY OF THE INVENTION

A primary object of the present invention is to provide an electric cord connector that will overcome the shortcoming of the prior art devices.

Another object is to provide an electric cord connector in which a base member and a cap member can be readily snap locked together so that electric cords will be in an operative coupled condition.

An additional object is to provide an electric cord connector in which the assembly between the cap member and base member can be accomplished without the use of special tools or skills.

A further object is to provide an electric cord connector that is simple and easy to use.

A still further object is to provide an electric cord connector that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

Figure 5:
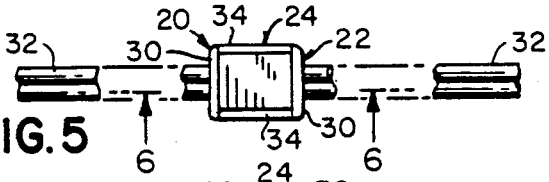
FIG. 5 is a top plan view taken in the direction of arrow 5 in FIG. 1 showing two electric cords coupled together therein.
Figure 6:
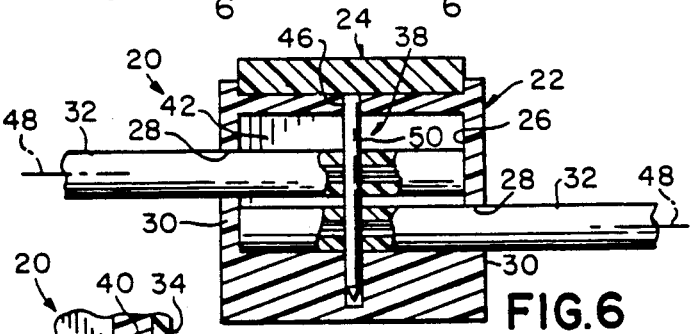
Figure 7:
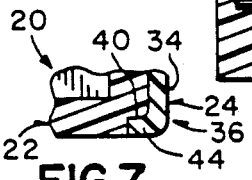
Figure 8:
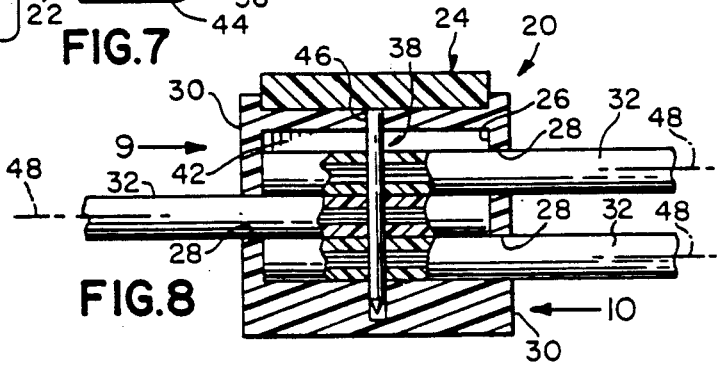
Figure 9:
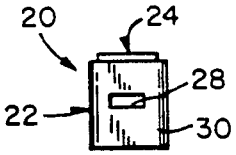
Figure 10:
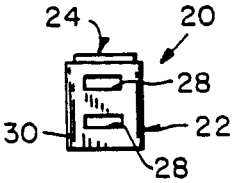
Figure 11:
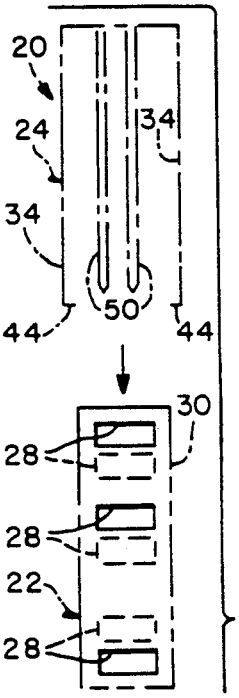

FIG. 6 a cross-sectional view taken along line 6—6 in FIG. 5;

FIG. 7 is a fragmentary elevational view of the invention shown in section, illustrating a lip of the cap member in locking engagement with a side groove of the base member;

FIG. 8 is similar to FIG. 6 but illustrates a second embodiment of the invention that couples three electric cords together;

FIG. 9 is an end view taken in the direction of arrow 9 in FIG. 8 and also shows the electric cords removed therefrom;

FIG. 10 is an opposite end view taken in the direction of arrow 10 in FIG. 8 and also shows the electric cords removed therefrom; and FIG. 11 is a diagrammatic end elevational view showing a third embodiment of the invention that may be employed to couple typically at least six electric cords together.

DETAILED DESCRIPTION OF THE PREFERRED EMBODIMENTS

Turning now descriptively to the drawings, in which like reference characters denote like elements throughout the several views, the Figures illustrate an electric cord connector 20 consisting generally of an insulted base member 22 and an insulted C-shaped cap member 24. The base member 22 has a chamber 26 with at least one aperture 28 formed offset in each end wall 30 thereof for receiving electric cords 32 to be coupled. The cap member 24 has a pair of structure 36, as best shown in FIG. 7, that are provided for assembling the base member 22 and the cap member 24 in a locked position while another structure 38, as best shown in FIGS. 6 and 8, is provided for coupling together the electric cords 32 when the base member 22 and the cap member 24 are assembled together.

Figure 2:
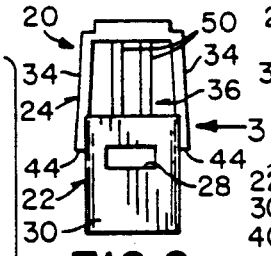
FIG. 2 is an end elevational view taken in the direction of arrow 2 in FIG. 1 showing the connector in a partially open condition prior to the electric cord insertion and engagement thereof.
Figure 4:
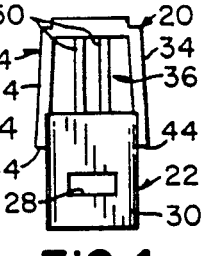
FIG. 4 is an opposite end elevational view taken in the direction of arrow 4 in FIG. 3.

The locking structure 36 includes the base member 22 having a groove 40 formed in each outer side wall 42 thereof. The cap member 24 has a lip 44 formed on each inner distal end of each side leg 34 so that the side legs 34 can flex outwardly to a skewed position, as best shown in FIGS. 2 and 4, to allow the lips 44 to snap under the grooves 40 in the side walls 42 of the base member 22 of a locked connection when assembled together.

The coupling structure 38 includes the base member 22 having a pair of spaced apart parallel holes 46 extending into the chamber 26 transversely into axis 48 of the apertures 28. A pair of pointed tip pins 50 are carried in a spaced apart parallel relationship in the cap member 24, extends inwardly between the side legs 34 and adapted to be received into the holes 46 to pierce the electric cords 32 so as to electrically connect as well as mechanically couple the electric cords together when the base member 22 and the cap members 24 are assembled together.

Figure 1:
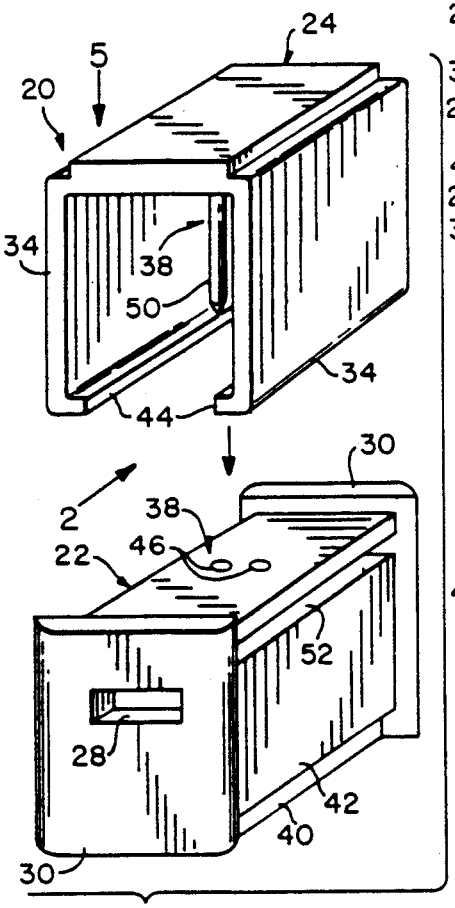
FIG. 1 is a greatly enlarged perspective view of the instant invention showing the cap member disengaged from the base member.
Figure 3:
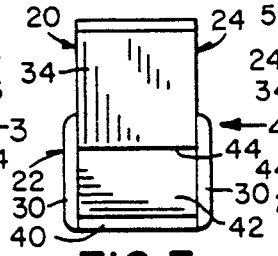
FIG. 3 is a side elevational view taken in the direction of arrow 3 in FIG. 2.

The base member 22 has a second groove 52, as best seen in FIG. 1, formed in each outer side wall 42 in a spaced apart parallel relationship with the first groove 40. The lips 44 on the legs 34 can fit into the second grooves 52 in a partially open condition prior to the electric cords 32 insertion into the apertures 28 in the base member as shown in FIGS. 2, 3 and 4. This keeps the connector 20 in a ready to be used condition.

The connector 20 can be structured to utilized two electric cords 32, as best seen in FIG. 6, three electric cords 32, as best seen in FIG. 8, and six electric cords 32, as best seen in FIG. 11. Other combinations not illustrated can also be utilized by simply changing the relative size of the base member 22 and cap member 24 to accommodate various amounts of electric cords 32.

To use the connector 20 a person simply places the electric cords 22 into their respective apertures 28 in the base member 22. The cap member 24 and the base member 22 are then pressed together until the lips 44 enter the grooves 40 so that the pins 50 can pierce the electric cords 32. The cap members 24 and base member 22 are now locked together to keep the electric cords 32 coupled to each other.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Electric cord connector for connecting together corresponding elongate multi-strand conductors of respective electrical cords of the ribbon type each comprising a pair of multi-strand conductors embedded to extend side-by-side in adjacent, spaced-apart relation within insulating sheaths integrally joined together by longitudinally extending web portions and comprising:

a) an insulated base member having a groove formed in each outer side wall thereof and a chamber with at least one aperture formed off-set in each end or thereof for receiving and locating end portions of respective electric cords to be coupled in overlapping face-to-face relation with the stranded conductors of one cord longitudinally aligned over respective corresponding stranded conductors of the other cord;

b) an insulted C-shaped cap member having a pair of flexible side legs adapted to be received by said base member, said cap member having a lip formed on each inner distal end of each said side leg so that side legs flex outwardly to a skewed position to allow said lips to snap under said grooves in said side walls of said base member for a locked connection when assembled together;

c) means for assembling said base member and said cap member together in a locked position;

d) said base member having a pair of spaced-apart parallel holes extending into said chamber transversely through axes of said apertures; and, e) a pair of pointed tip pins carried in spaced apart parallel relationship in said cap member, extending inwardly between said side legs and adapted to be received into said respective holes and to pierce the respective corresponding conductors of both electric cords so as to electrically connect the corresponding conductors of both electric cords together when said base member and said cap member are assembled together.

2. Electric cord connector as recited in claim 1, further including said base member having a second groove formed in each outer side wall in a spaced apart parallel relationship with each said first groove so that said lips on said legs can fit into said second grooves in a partially open condition prior to the electric cords insertion into said base member.

* * * * *